United States Patent [19]

Hoyt

[11] Patent Number: 4,461,231

[45] Date of Patent: Jul. 24, 1984

[54] SAILING CRAFT

[76] Inventor: John G. Hoyt, 49 America's Cup Ave., Newport, R.I. 02840

[21] Appl. No.: 410,502

[22] Filed: Aug. 23, 1982

[51] Int. Cl.[3] ..... B63B 15/00; B63H 9/08

[52] U.S. Cl. ..... 114/102; 114/39; 114/97; 114/112

[58] Field of Search ..... 114/97, 98, 89, 102, 114/103, 104, 105, 39, 90, 112

[56] References Cited

U.S. PATENT DOCUMENTS 3,112,725 12/1963 Malrose ..... 114/39
4,059,063 11/1977 Hood et al. ..... 114/39

FOREIGN PATENT DOCUMENTS 954871 3/1964 United Kingdom ..... 114/90

*Primary Examiner*—Trygve M. Blix
*Assistant Examiner*—Edwin L. Swinehart
*Attorney, Agent, or Firm*—Barlow & Barlow, Ltd.

[57] ABSTRACT

A sailing craft having a mast mounted therein is provided with a track on the mast for supporting the vertical edge of a sail. To support the upper portion of the sail, an L-shaped gaff is provided having two legs, one leg being substantially parallel to the mast and contained against the mast by track slides or bolt ropes, while the other leg extends at an angle to the mast and supports the upper edge of the sail. The gaff is supported in an elevated position by a halyard that extends through a block at the upper tip of the mast, and a traveler is provided to change the position of the halyard along the gaff on the leg portion that extends away from the mast.

7 Claims, 5 Drawing Figures

SAILING CRAFT

BACKGROUND OF THE INVENTION

In sail boats with traditional gaffs there is a spar that is hoisted up the mast by a pair of halyards. One of the halyards is considered a throat halyard and connects to the gaff near the portion that rests against the mast, while the other is called the peak halyard and is somewhat outwardly of the gaff near the bitter end thereof. This well-known type of a gaff system utilizes a rather heavy spar and, in the traditional sense, involved a throat, which partially embraced a round mast, and entailed the utilization of rings that encircled the mast in order to hold the luff or the leading vertical edge of the sail against the mast. This gaff system has basically fallen into disfavor primarily due to the fact that the gaff was large, bulky and generally was considered to be aerodynamically inefficient.

SUMMARY OF THE INVENTION

The present invention relates to a new gaff system which is based on a cantilever theory and which requires but one halyard. The gaff can be light and efficient. Essentially in a sailing craft which has a mast, a cantilever gaff is constructed in essentially an L-shape with one leg of the L lying parallel to the mast and being supported thereby in a variety of ways, as for example, by bolt ropes, slides or other mechanical means; and where the other leg of the gaff, which extends away from the mast, may be suitably constructed to provide lateral stiffness as by means of utilizing a flange or ribs or the like and may maintain its vertical stiffness by virtue of the fact that it may consist of an elongated plate which is substantially parallel to a sail which it supports. The leg of the gaff that extends away from the mast may have a traveler track fastened thereto so that an adjustable lead for the halyard may be had by a traveler that freely rides on the track. For example, in the normal position, the gaff will be hoisted by a halyard which is at an attachment point adjacent the mast; but when the sail is in a reefed position, the halyard may be moved to the outer end of the gaff to support the greater leach loads that would be encountered in heavier winds.

DETAILED DESCRIPTION OF THE PREFERRED EMBODIMENTS

Figure 1:
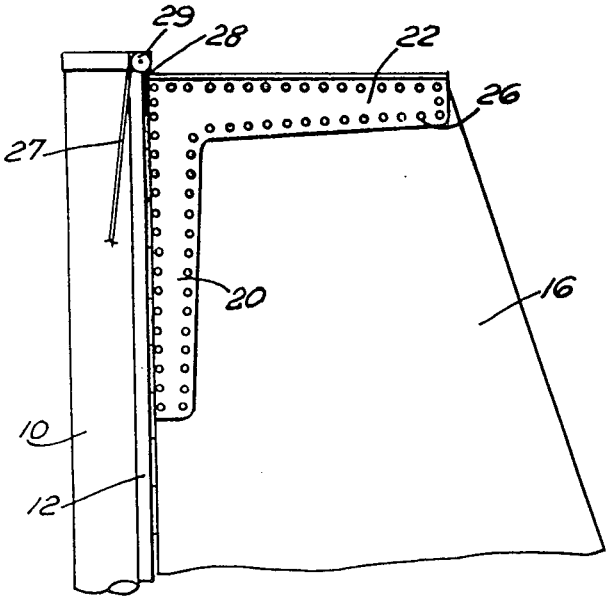
FIG. 1 is a partial elevational view showing the gaff of my invention.
Figure 2:
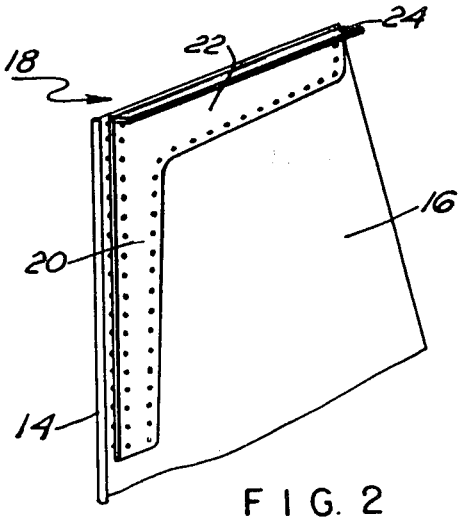
FIG. 2 is a fragmentary perspective view illustrating the gaff.

Referring now to the drawings and to FIG. 1 thereof, there is illustrated a mast 10 of a sailing craft which is provided along its aft side with a track 12 in the form of a groove into which the bolt rope 14 of a sail 16 may be fed. Attached to the upper edge of the sail 16 is a gaff generally designated 18 in the form of a plate which has a first leg 20 that parallels the bolt rope 14 of the sail, but is spaced therefrom, while the other or second leg 22 of the gaff extends generally away from the mast. The leg 22 may be provided for stiffening purposes with a rib or flange 24, and the gaff is preferably attached by rivets 26 to the sail so that it forms an integral part thereof. The leg 20 is therefore held against the mast by the bolt rope 14. The rivets 26 may be arranged as seen in FIG. 1, or any other fashion that is suitable to fixedly adhere the gaff to the sail. A halyard 27 may be attached to the gaff as at 28 and the halyard will pass through a sheave 29 at the top of the mast and thence may be led downwardly to the deck of the sailing craft.

Figure 3:
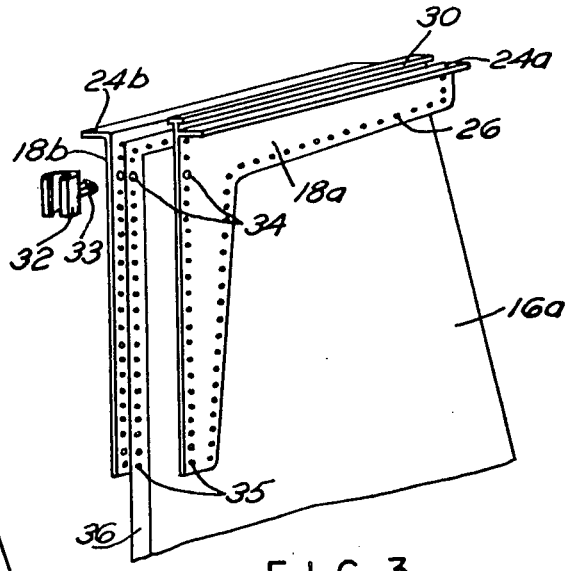
FIG. 3 is a detached elevational view showing the gaff in a lowered reefed position.
Figure 4:
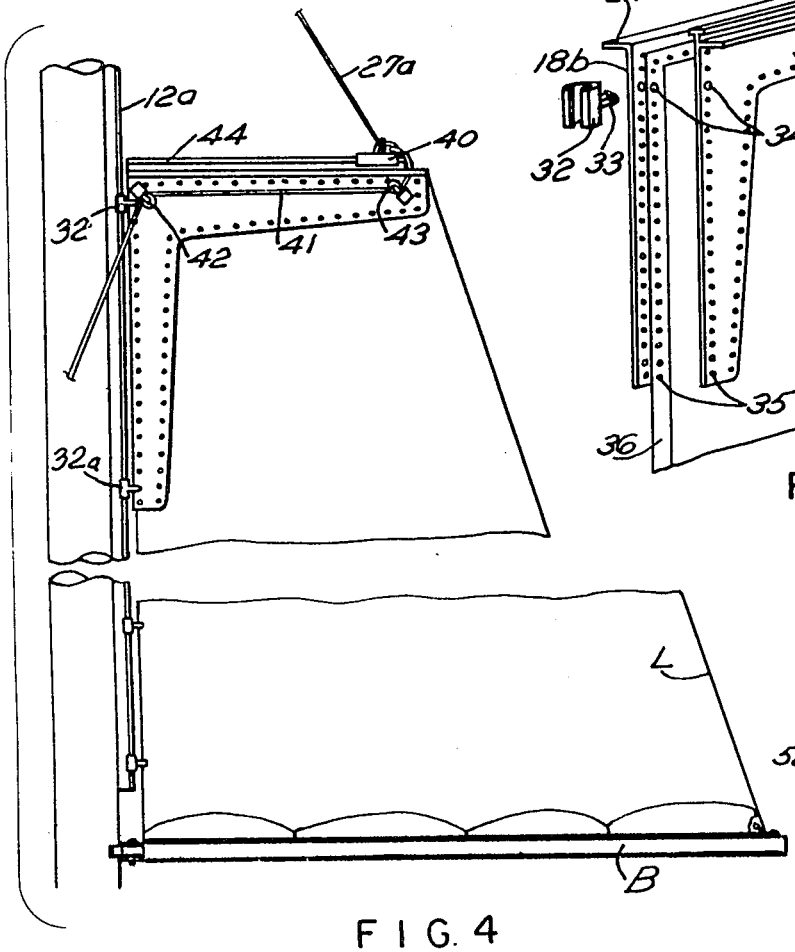
FIG. 4 is a detached perspective view illustrating my alternate embodiment.

Referring to FIGS. 3 and 4, a slightly modified form of a gaff is illustrated in which two L-shaped gaff portions are illustrated, there being one face section **18*a* in the form of a plate and a mating section 18*b* to form effectively a sandwich about the sail. In the illustrated version, the gaff 18*a* is provided with a flange or stiffening rib 24*a* and the portion 18*b* is likewise formed with a flange or stiffening rib 24*b*. A track 30 is shown as being fixedly attached to the gaff portion 18*a* and when the gaff sections are assembled into sandwiched relationship to the sail, and fastened thereto by rivets 26, the gaff is held against the mast by means of sliders such as slider 32 that has a shackle portion 33 that engages the apertures 34 in the gaff and the sail. A similar slider 32*a* will be provided at the apertures 35. To this end, to utilize the arrangement as shown in FIG. 3, the mast is provided with a trackway 12*a* that is on the aft face of the mast, and sliders such as 32 will be also attached to the sail so that the sail is held against the mast by a plurality of sliders extending up the luff thereof, which luff is seen in FIG. 3 by the reinforcing tape at 36**.

To the track 30 a slider 40 may be engaged and the position of this slider may be partially controlled by a control line 41 which passes through a plurality of guide means 42, 43. It will be normal for the traveler to assume a position as at 44 when in normal operation due to the fact the slider will assume a vertical hoisting position and will need to be pulled outwardly to the position as seen in FIG. 4 by the line 41 when the traveler 40 is hauled out to this position. The halyard **27*a* will now be in a position to support the after end of the arm of the gaff so as to resist the large leach loads that are encounted in heavier winds, which is the condition illustrated in FIG. 4** where the sail has been furled against the boom B to shorten both the luff and the leach L.

Figure 5:
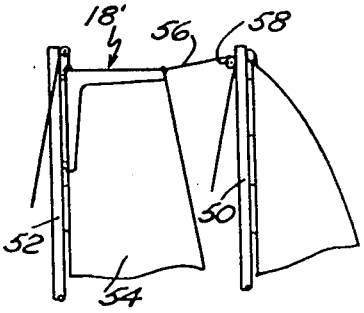
FIG. 5 is a fragmentary elevational view on a reduced scale showing use of the gaff on a two-masted schooner rig.

Referring to FIG. 5, there is illustrated a two-masted schooner rig with a main mast 50 and a foremast 52. To the foremast there is attached a foresail 54 with a gaff 18'. A line 56 leads from the aft end of the gaff through a block 58 down to the deck of the vessel. By adjusting the line 56 a foresail with a squared-off wing tip can be created. Thus, the gaff can be maintained in substantial alignment with the boom (not shown).

I claim:

1. In a sailing craft having a mast, a sail, track means on the mast supporting a vertical edge of the sail, a gaff in the form of an L-shaped plate having substantial width, said gaff fastened to the sail wherein its two legs support the upper edge of the sail, the first leg of said gaff that parallels the mast extending a substantial distance therealong and being held against the mast by said track means affixed to the sail, a second leg extending outwardly from said first leg and at an angle thereto and halyard means supporting the sail and gaff in an elevated position on the mast.

2. The combination of claim 1 including an adjustable traveler on said other leg of said gaff and wherein the halyard means supporting the sail is attached to said traveler.

3. The combination of claim 1 wherein the leg of the gaff at the upper edge of the said sail has a stiffening means therealong to resist bending.

4. The combination of claim 1 wherein the track means is external to the mast along the surface thereof and wherein track sliders are fastened to the sail and to the gaff to slidably support the same against the mast.

5. The combination of claim 1 wherein the track means is a groove and wherein the leading edge of the sail has an enlargement that engages the groove.

6. The combination of claim 5 wherein the gaff is fastened to the sail spaced from said enlargement on the sail to permit the free movement of the sail in the groove.

7. The combination of claim 1 wherein a mating plate in the form of the L-shaped gaff is provided, said plate sandwiching the sail.

* * * * *